US008103028B2

(12) United States Patent
Li et al.

(10) Patent No.: US 8,103,028 B2
(45) Date of Patent: Jan. 24, 2012

(54) ELECTROSTATIC LOUDSPEAKER

(76) Inventors: Gang Li, SuZhou (CN); Wei Hu, SuZhou (CN); Jia Xin Mei, SuZhou (CN)

( * ) Notice: Subject to any disclaimer, the term of this patent is extended or adjusted under 35 U.S.C. 154(b) by 353 days.

(21) Appl. No.: 12/571,389

(22) Filed: Sep. 30, 2009

(65) Prior Publication Data

US 2011/0007914 A1 Jan. 13, 2011

(30) Foreign Application Priority Data

Jul. 12, 2009 (CN) ..... 2009 1 0160443

(51) Int. Cl.
*H04R 1/02* (2006.01)
*H04R 25/00* (2006.01)

(52) U.S. Cl. ..... 381/191; 381/189; 381/393

(58) Field of Classification Search ..... 381/190, 381/191, 386, 393, 189, 394, 174, 178, 369, 381/176, 173, 175; 181/148, 198, 199
See application file for complete search history.

(56) References Cited

U.S. PATENT DOCUMENTS

| | | | | |
|---|---|---|---|---|
| RE28,420 | E * | 5/1975 | Murphy | 381/191 |
| 6,044,160 | A * | 3/2000 | Norris | 381/191 |
| 6,125,189 | A * | 9/2000 | Yasuno et al. | 381/111 |
| 2006/0177083 | A1 * | 8/2006 | Sjursen et al. | 381/322 |
| 2007/0104339 | A1 | 5/2007 | Izuchi et al. | |
| 2007/0121967 | A1 * | 5/2007 | Sjursen et al. | 381/111 |
| 2007/0189559 | A1 | 8/2007 | Haan et al. | |

* cited by examiner

*Primary Examiner* — Tuan Nguyen
(74) *Attorney, Agent, or Firm* — Cheng-Ju Chiang

(57) ABSTRACT

An electrostatic loudspeaker includes a backplate having a metal film acting as one electrode of a capacitor and defining a number of sound apertures therein; a diaphragm insulatively spaced a distance from the backplate to form the capacitor; the diaphragm comprising a metal film acting as the other electrode of the capacitor; a back chamber having a substrate and an insulative spacer for joining edge portions of the diaphragm and the substrate; a driving circuit element for converting electrical signals from exterior input pads into driving signals to drive the diaphragm to vibrate and sound; the driving circuit element being mounted on an inner surface of the substrate and being accommodated in the back chamber; and a first, second and third connection paths for respectively electrically connecting the driving circuit element with the two electrodes of the capacitor, and the exterior input pads. An electrostatic loudspeaker with two backplates is also disclosed.

20 Claims, 4 Drawing Sheets

ELECTROSTATIC LOUDSPEAKER

BACKGROUND OF THE INVENTION

1. Field of the Invention

The present invention relates to an electroacoustic transducer, and more particularly relates to a small or miniature electrostastic loudspeaker (ESL).

2. Description of Related Art

Loudspeaker is an electroacoustic transducer for changing electrical signals into sound. The loudspeaker pushes a medium in accord with the pulsations of an electrical signal, thus causing sound waves to propagate to where they can then be received by the ear. According to the different physical effects of the electroacoustic conversion, the loudspeakers are divided into many kinds of types, such as magnetic loudspeaker, piezoelectric loudspeaker, electrostatic loudspeaker (condenser loudspeaker) and moving-coil loudspeaker (dynamic loudspeaker). Each type of the loudspeaker has advantages and disadvantages. In recent years, the moving-coil loudspeaker has been widely used because of the advantages in relatively great variety and mature manufacturing process.

The loudspeakers are almost applied in each kind of electrical consumer products. With the development of use in portable consumer products for audio communication and audio/video playing, such as walkman, cell phone, the market of the loudspeaker which is recognized as the key part of the consumer products becomes larger and larger.

At present, the moving-coil loudspeaker takes up a large share of the market. The moving-coil loudspeaker has a vibration system and magnetic system. The vibration system is operated by the electro-magnetic interaction to produce mechanical movement, and further radiate sound-waves into air. However, the vibration system has a heavy quality which limits the application of the moving-coil loudspeaker in the portable products. In addition, the frequency response is not flat and has worse performance in high-range frequency.

The electrostatic loudspeaker mainly has a diaphragm and stationary electrode which forms a capacitor with the diaphragm. The electrostatic loudspeaker is driven by the static-electricity on the capacitor to work. When the electrostatic loudspeaker works, the capacitor electrically connects with a pair of power sources to polarize the two electrodes, the diaphragm and stationary electrode, to produce an electrostatic field therebetween. When audio signals are inputted, the diaphragm is driven by the signal currents supplied by the electrostatic field to vibrate and sound, and then radiate sound-waves to exterior through sound apertures located on the stationary electrode.

The electrostatic loudspeaker adopts the static-driven vibration system which is light and thin without the coils and the like elements in the moving-coil loudspeaker. Therefore, the electrostatic loudspeaker can expand the high frequency characteristic, and meanwhile improve the flatness of the frequency response. The electrostatic loudspeaker also has an advantage of small distortion. Conclusively, the structure of the electrostatic loudspeaker is easy to be small-sized and light, and is in accordance with the development trend of electrical consumer products.

BRIEF SUMMARY OF THE INVENTION

According to one aspect of the present invention, an electrostatic loudspeaker includes: a backplate having a metal film acting as one electrode of a capacitor and defining a plurality of sound apertures therein; a diaphragm spaced a distance from the backplate insulatively to form the capacitor; the diaphragm comprising a metal film acting as the other electrode of the capacitor; a back chamber having a substrate and an insulative spacer for joining edge portions of the diaphragm and the substrate; a driving circuit element for converting electrical signals from exterior input pads into driving signals to drive the diaphragm to vibrate and sound; the driving circuit element being mounted on an inner surface of the substrate and being accommodated in the back chamber; and a first, second and third connection paths for respectively electrically connecting the driving circuit element with the two electrodes of the capacitor, and the exterior input pads.

According to another aspect of the present invention, an electrostatic loudspeaker includes: a first and second backplates each having a metal film; a diaphragm being sandwiched between the first and second backplates and having a metal film which forms a first capacitor with the metal film of the first backplate and forms a second capacitor with the metal film of the second backplate; the metal films of the first and second backplates being applied inverse voltage when the electrostatic loud speaking working; a substrate being located below the diaphragm; a driving circuit element being mounted on the substrate for converting electrical signals from exterior input pads into driving signal to drive the diaphragm to vibrate and sound; a plurality of connection paths respectively for electrically connecting the driving circuit element with the metal films of the first backplate, the second backplate and diaphragm, and the exterior input pads; and a shielding case enclosing the connection paths therein.

According to the other aspect of the present invention, an electrostatic loudspeaker includes: first and second backplates each having a metal film; a diaphragm being sandwiched between the first and second backplates and having a metal film which forms a first capacitor with the metal film of the first backplate and forms a second capacitor with the metal film of the second backplate; a back chamber having a substrate and an insulative spacer for joining edge portions of the second backplate and the substrate; the substrate having a first metal layer which is formed on an inner surface of the substrate and divided into several separate parts being electrically insulative to each other; a driving circuit element for converting electrical signals into driving signals to drive the diaphragm to vibrate and sound; the driving circuit element being mounted on the inner surface of the substrate and being accommodated in the back chamber; a plurality of metal connection posts extending through the diaphragm, the second backplate, the insulative space and the substrate; the metal connection posts of the diaphragm, the second backplate, and the insulative space electrically connecting with some of the separate parts of the first metal layer to establish one connection path; the connection post of the insulative space electrically connecting with another some of the separate parts of the first metal layer to establish another connection path; the connecting posts of the substrate electrically connecting with the other some of the separate parts of the first metal layer to establish other connection path. The one connection path and the another connection path provides inverse voltage to the metal films of the first and second backplates from the driving circuit element.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

In the following description, numerous specific details are set forth to provide a thorough understanding of the present invention. The drawings and detail description of several embodiments are considered as an exemplification of the principles of the present invention and are not intended to limit the scope of the invention to the embodiments illustrated. Besides, these drawings schematically illustrate the embodiments of the present invention, and the dimension and proportion of elements are not intended to limit the structure of the present invention.

The First Embodiment

Figure 1:
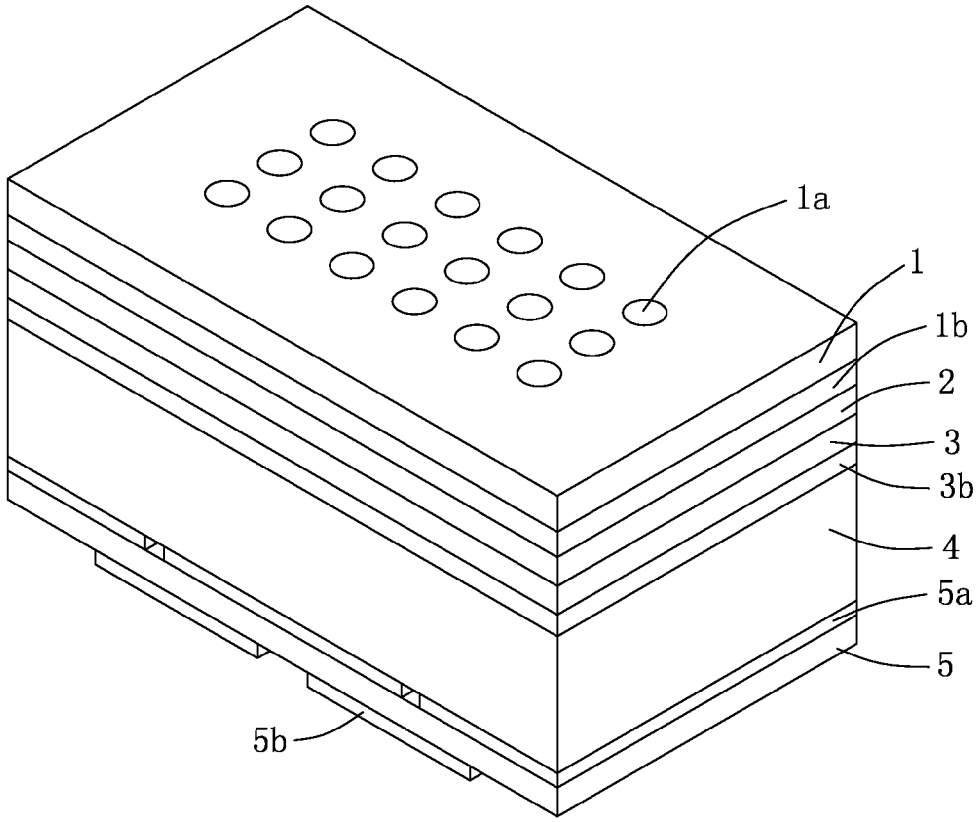
FIG. 1 is a schematic perspective view of an electrostatic loudspeaker according to a first embodiment of the present invention.
Figure 2:
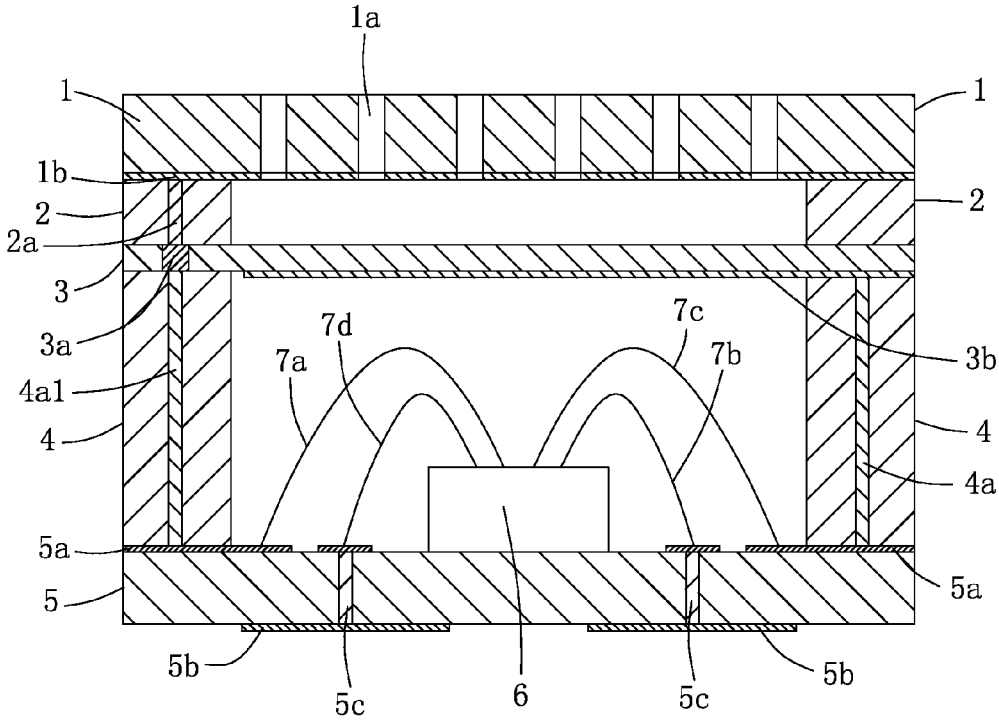
FIG. 2 is a cross-sectional view of the electrostatic loudspeaker shown in FIG. 1.

Referring to FIGS. 1 to 2, an electrostatic loudspeaker according to the first embodiment of the present invention is provided. The electrostatic loudspeaker has a backplate 1, a diaphragm 3, an insulator 2, an insulative spacer 4, a substrate 5, a plurality of metal wires 7 and a plurality of metal connection posts. The backplate 1, the insulative spacer 4 and the substrate 5 are mainly formed by insulative materials, such as FR-4, G10, BT. The backplate 1 opens a plurality of sound apertures 1*a* through which sound waves are radiated to exterior when the diaphragm 3 being driven to vibrate and sound. Further, the size, amount, shape and arrangement of the sound apertures 1*a* are determined depending on the acoustic characteristic requirements, for example, the sound apertures 1*a* can be shaped in round or rectangle.

The backplate 1 has the base material and a metal film 1*b*. The metal film 1*b* is formed on an inner surface of the backplate 1. The diaphragm 3 has a base film and a metal film 3*b*, and the base film is formed by organic film, such as PTE, PE, PVC, PTFE. The insulator 2 is located between the backplate 1 and the diaphragm 3 for connecting and supporting the edge portions thereof to make sure that the backplate 1 and the diaphragm 3 are electrically insulated to each other. In such configuration, a capacitor is formed and the metal film 1*b* of the backplate 1 and the metal film 3*b* of the diaphragm 3 act as two electrodes of the capacitor.

Specially referring to FIG. 2, the diaphragm 3 further has a metal connection post 3*a* extending vertically through upper and lower surfaces thereof. One side wall of the insulator 2 also has a metal connection post 2*a* which extends vertically through upper and lower surfaces thereof to electrically connect with the metal connection post 3*a* of the diaphragm 3.

The insulative spacer 4 is opposite to the backplate 1 and peripherally connects the diaphragm 3 with substrate 5 to form a back chamber which is acoustic airtight. A driving circuit element 6 is mounted on the substrate 5 and is accommodated by the back chamber. The electrostatic loudspeaker not only can effectively adjust the acoustic characteristic but also can achieve a small-size because of the structure of back chamber.

Further, two opposite side walls of the insulative spacer 4 respectively have a metal connection post 4*a* and 4*a*1 extending through upper and lower surfaces thereof. The metal connection post 4*a*1 is electrically connected with the metal connection post 3*a* of the diaphragm 3, while the metal connection post 4*a* is electrically connected with the metal film 3*b* of the diaphragm 3.

The substrate 5 has a first metal layer 5*a* which is located on the inner (upper) surface thereof and a second metal layer 5*b* which is located on the outer (lower) surface thereof. The second metal layer 5*b* has several pads some of which function as exterior input pads of the whole electrostatic loudspeaker. The substrate 5 further has a plurality of metal connection posts 5*c* extending through the upper and lower surfaces thereof to establish an electrical connection between the first metal layer 5*a* and the second metal layer 5*b*.

As above-mentioned, the driving circuit element 6 is mounted on the upper surface of the substrate 5 and establishes an electrical connection with the first metal layer 5*a* via the metal wires 7*a*, 7*b*, 7*c* and 7*d*. Connection parts of the first metal layer 5 contacting with the metal wires 7*a*, 7*b*, 7*c* and 7*d* are respectively defined as a first part, a second part and a third part (the connection parts contacting with the metal wiring 7*c* and 7*d* are jointly defined as the third part). When electrical signals are inputted through the exterior pads of the second metal layer 5*b*, the metal connection posts 5*c*, the third part of the first metal layer 5*a* and the metal wires 7*b*, 7*d* (one connection path), the driving circuit element 6 receives the input electrical signals and converts them into driving signals. One road of the driving signals are transmitted through the metal wire 7*a*, the first part of the first metal layer 5*a*, the metal connection post 4*a*1 of the insulative spacer 4, the connection post 3*a* of the diaphragm 3, the connection post 2*a* (another connection path) and finally get to the metal film 1*b* of the backplate 1; the other road of the driving signals are transmitted through the metal wire 7*c*, the second part of the first metal layer 5*a*, the connection post 4*a* of the insulative spacer 4 (the other connection path) and finally get to the metal film 3*b* of the diaphragm 3. As a result, the two electrodes (the backplate 1 and diaphragm 3) respectively establish an electrical connection with the driving circuit element 6. The two electrodes are polarized to produce an electrostatic filed to drive the diaphragm 3 to vibrate and sound. The sound is radiated out through the sound apertures 1*a*. Hereby, the function of the electrostatic loudspeaker is wholly achieved.

The Second Embodiment

Figure 3:
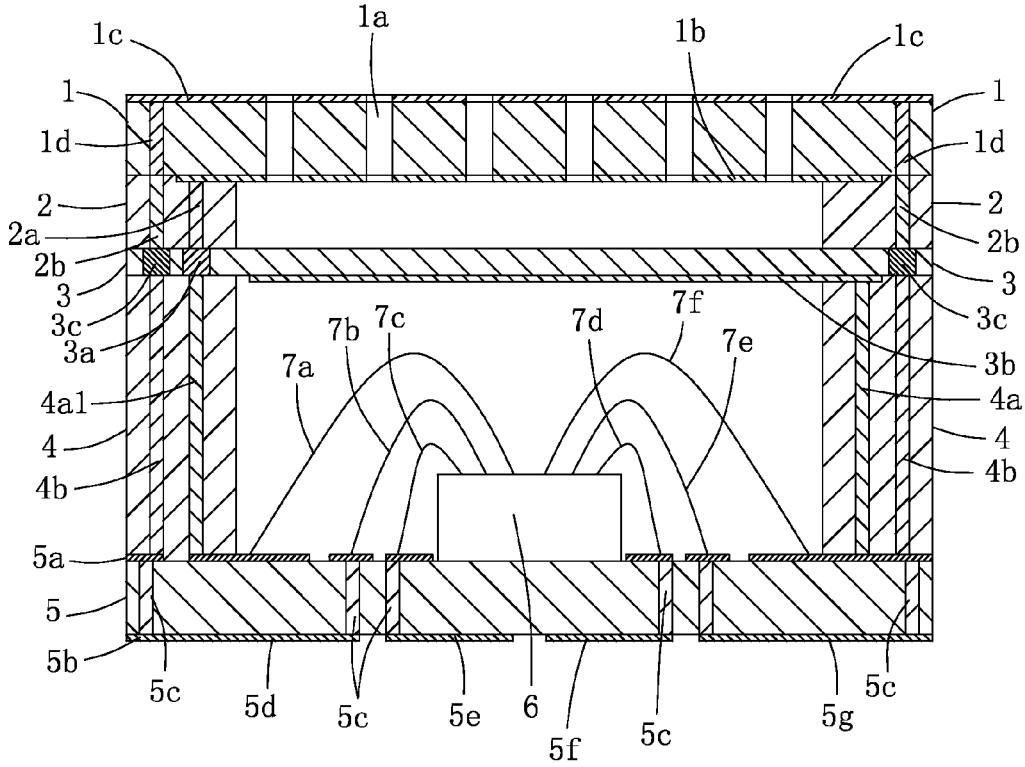
FIG. 3 is a schematic cross-sectional view of an electrostatic loudspeaker according to a second embodiment of the present invention.

Referring to FIG. 3, another electrostatic loudspeaker according to the second embodiment of the present invention is disclosed. Comparing to the first embodiment of the present invention, the electrostatic loudspeaker of the second embodiment further has a shielding case to prevent connections paths from the electromagnetic interference.

The electrostatic loudspeaker has a backplate 1, a diaphragm 3, an insulator 2, a insulative spacer 4, a substrate 5, the shielding case, a plurality of metal wires 7 and a plurality of metal connection posts. The backplate 1, the insulative spacer 4 and the substrate 5 are mainly formed by insulative materials, such as FR-4, G10, BT. The backplate 1 opens a plurality of sound apertures 1*a* through which sound waves are radiated to exterior when the diaphragm 3 being driven to vibrate and sound. Further, the size, amount, shape and arrangement of the sound apertures 1*a* are determined depending on the acoustic characteristic requirements, for example, the sound apertures 1*a* can be shaped in round or rectangle.

The backplate 1 has the base material and a metal film 1*b*. The metal film 1*b* is formed on an inner surface of the backplate 1. The diaphragm 3 has a base film and a metal film 3*b*, and the base film is formed by organic film, such as PTE, PE, PVC, PTFE. The insulator 2 is located between the backplate 1 and the diaphragm 3 for connecting and supporting the edge portions thereof to make sure that the backplate 1 and the diaphragm 3 are electrically insulated to each other. In such configuration, a capacitor is formed and the metal film 1*b* of the backplate 1 and the metal film 3*b* of the diaphragm 3 act as two electrodes of the capacitor. The backplate 1 further has a metal shielding layer 1*c* covering an upper (outer) surface thereof and a metal shielding interlayer 1*d* which extends through the upper and lower surfaces thereof to electrically connect with the metal shielding layer 1*c*. It should be known that the metal film 1*b* and the metal shielding layer 1*c* can be made of cuprum, aurum, nickel or the like materials.

The diaphragm 3 further has a metal connection post 3*a* extending vertically through upper and lower surfaces thereof. One side wall of the insulator 2 also has a metal connection post 2*a* which extends vertically through upper and lower surfaces thereof to electrically connect with the metal connection post 3*a* of the diaphragm 3. The diaphragm 3 further has a metal shielding interlayer 3*c*.

Besides the metal connection post 2*a*, the insulator 2 has a metal shielding interlayer 2*b* which extends vertically through upper and lower surfaces thereof to electrically connect with the metal shielding interlayer 3*c* and the metal shielding interlayer 1*d*. Furthermore, the metal shielding interlayer 2*b* should be located outside of the metal connection post 2*a*.

The insulative spacer 4 is opposite to the backplate 1 and peripherally connects the diaphragm 3 with the substrate 5 to form a back chamber which is acoustic airtight. A driving circuit element 6 is mounted on the substrate 5 and is accommodated by the back chamber. The electrostatic loudspeaker not only can effectively adjust the acoustic characteristic but also can achieve a small-size because of the structure of back chamber.

Further, two opposite side walls of the insulative spacer 4 respectively have a metal connection post 4*a* and 4*a*1 extending through upper and lower surfaces thereof and a metal shielding interlayer 4*b* correspondingly protecting the connection post 4*a* and the connection post 4*a*1. The connection post 4*a*1 is electrically connected with the connection post 3*a* of the diaphragm 3, while the connection post 4*a* is electrically connected with the metal film 3*b* of the diaphragm 3.

The substrate 5 has a first metal layer 5*a* which is located on inner the (upper) surface thereof, a second metal layer 5*b* which is located on the outer (lower) surface thereof and a plurality of metal connection posts 5*c* establishing an electrical connection between the first metal layer 5*a* and the second metal layer 5*b*. The driving circuit element 6 is mounted on the upper surface of the substrate 5 and establishes an electrical connection with the first metal layer 5*a* via the metal wires 7*a*, 7*b*, 7*c*, 7*d*, 7*e* and 7*f*. The connection parts of the first metal layer 5 for contacting with the metal wires 7*a*, 7*b*, 7*c*, 7*d*, 7*e* and 7*f* and corresponding metal connection posts. The second metal layer 5*b* is graphically divided into a plurality of electrode pads 5*d*, 5*e*, 5*f*, 5*g* etc, wherein the electrode pad 5*d* and 5*g* are defined as grounding pads. The metal wire 7*a* electrically connects with the first metal layer 5*a*, the metal connection posts 4*a*1, 3*a* and 2*a* to establish a first connection path. The metal wire 7*f* electrically connects with the first metal layer 5*a* and the metal connection post 4*a* to establish a second connection path. The metal wires 7*c* and 7*d* electrically connects with the first metal layer 5*a* and the connection posts 5*c* to establish a third connection path. When electrical signals are inputted from the electrode pads 5*e* and 5*f* and transmitted into the driving circuit element 6 via the third connection path. The driving circuit element 6 converts the electrical signals into driving signals. One road of the driving signals gets to the metal film 1*b* of the backplate 1 via the first connection path. The other road of the driving signals gets to the metal film 3*b* of the diaphragm 3 via the second connection path. As a result, the two electrodes (the backplate 1 and diaphragm 3) respectively establish electrical connection with driving circuit element 5. The two electrodes are polarized to produce an electrostatic filed to drive the diaphragm 3 to vibrate and sound. The sound is radiated out through the sound apertures 1*a*. Hereby, the function of the electrostatic loudspeaker is wholly achieved. The metal shielding layer 1*c*, the metal shielding interlayer 1*d*, 2*b*, 3*c* and 4*b*, the second metal layer 5*b* (the grounding pads 5*d* and 5*g*), some of the metal connection posts 5*c* and the metal wires 7*b*, 7*e* are electrically connected together and jointly forms into the shielding case which encloses substantial parts or elements of the electrostatic loudspeaker to prevent them from exterior interference.

The Third Embodiment

Figure 4:
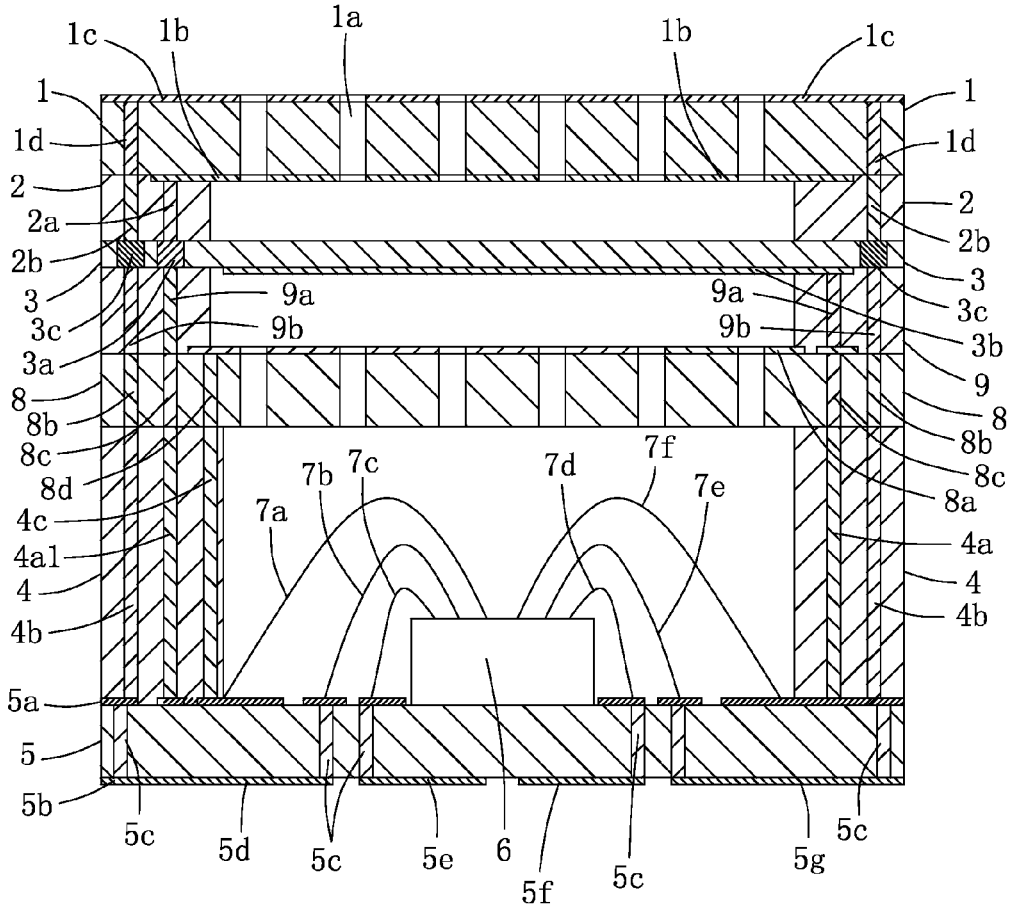
FIG. 4 is a schematic cross-sectional view of an electrostatic loudspeaker according to a third embodiment of the present invention.

As shown in FIG. 4, another electrostatic loudspeaker according to the third embodiment of the present invention is disclosed. The electrostatic loudspeaker has a first backplate 1, a diaphragm 3, a first insulator 2, an insulative spacer 4, a substrate 5, and a driving circuit element 6, a plurality of metal wires 7, a second backplate 8, a second insulator 9, a shielding case, and a plurality of metal connection posts. It is noted that the first backplate 1 is the same as the backplate 1 in the first and second embodiments. Using the different term to indicate the same part is not intended to confuse the skilled person in this art, but conveniently describe the third embodiment of the present invention. The diaphragm 3 is sandwiched between the first backplate 1 and the second backplate 2. When the electrostatic loudspeaker working, the first backplate 1 and the second backplate 2 are applied inverse voltage so that they seldom adhesively contacts with the diaphragm 3 with the radiated sound power is improved.

The first backplate 1, the second backplate 8, the first insulator 2, the second insulator 9, the insulative spacer 4 and the substrate 5 are mainly formed by insulative materials, such as FR-4, G10, BT. Both of the backplates 1, 8 open a plurality of sound apertures 1*a*, 8*a* through which sound waves are radiated to exterior when the diaphragm 3 being driven to vibrate and sound. Further, the size, amount, shape and arrangement of the sound apertures 1*a*, 8*a* are determined depending on the acoustic characteristic requirements, for example, the sound apertures 1*a*, 8*a* can be shaped in round or rectangle.

The first backplate 1 has a first metal film 1*b* which formed on an inner surface of the first backplate 1. The first metal film 1*b* is the same as the metal film 1*b* in the first and second embodiments. The first backplate 1 further has a metal shielding layer 1*c* covering an upper (outer) surface thereof and a metal shielding interlayer 1*d* which extends through the upper and lower surfaces thereof to electrically connect with the metal shielding layer 1*c*. It should be known that the metal film 1*b* and the metal shielding layer 1*c* can be made of cuprum, aurum, nickel or the like materials. The second backplate 8 has a second metal film 8*a* which is formed on an upper surface thereof. The first and second metal films 1*a*, 8*a* are applied inverse voltage, and they corporately drive the diaphragm 3 to vibrate and sound in a higher driving power and fewer adhesive contacts among them. The second backplate 8 further has a metal shielding interlayer 8*b* and metal connection posts 8*c* and 8*d*, wherein the connection post 8*d* electrically contact with the second metal film 8*a*.

The diaphragm 3 has a base film, a metal film 3*b*, a metal connection post 3*a* extending vertically through upper and lower surfaces thereof and a metal shielding interlayer 3*c*. The base film is formed by organic film, such as PTE, PE, PVC and PTFE.

The first insulator 2 is located between the first backplate 1 and the diaphragm 3 for connecting and supporting the edge portions thereof to make sure that the first backplate 1 and the diaphragm 3 are electrically insulated to each other. The first insulator 2 has a metal connection post 2*a* which extends vertically through upper and lower surfaces thereof to electrically connect with the metal connection post 3*a*, and a metal shielding interlayer 2*b* which is substantially parallel to the metal connection post 2*a* and extends beyond the upper and lower surfaces thereof to electrically connect with the metal shielding interlayer 3*c* and the metal shielding layer 1*d*. Furthermore, the metal shielding interlayer 2*b* should be located outside of the metal connection post 2*a*.

The second insulator 9 is located between the second backplate 8 and the diaphragm 3 for connecting and supporting the edge portions thereof to make sure that the second backplate 8 and the diaphragm 3 are electrically insulated to each other. The second insulator 9 has a metal connection post 9*a* which extends vertically through upper and lower surfaces thereof to electrically connect with the metal connection post 3*a* and the metal connection post 8*c*, and a metal shielding interlayer 9*b* which is substantially parallel to the metal connection post 9*a* and extends beyond the upper and lower surfaces thereof to electrically connect with the metal shielding interlayer 3*c* and the metal shielding interlayer 8*b*. Furthermore, the metal shielding interlayer 9*b* should be located outside of the metal connection post 9*a*.

In such configuration, a first capacitor is formed by the metal film 1*b* of the backplate 1 and the metal film 3*b* of the diaphragm 3 which act as two electrodes of the first capacitor. A second capacitor is formed by the metal film 8*b* of the backplate 8 and the metal film 3*b* of the diaphragm 3 which acts as two electrodes of the second capacitor.

The insulative spacer 4 is located below the second backplate 8. The insulative 4 peripherally connect the diaphragm 3 with substrate 5 to form a back chamber which is acoustic airtight. The driving circuit element 6 is mounted on the substrate 5 and is accommodated by the back chamber. The electrostatic loudspeaker not only can effectively adjust the acoustic characteristic but also can achieve a small-size because of the structure of back chamber. Side walls of the insulative spacer 4 have a metal connection post 4*a*, 4*a*1 and 4*c* extending through upper and lower surfaces thereof and a metal shielding interlayer 4*b* for protecting the metal connection post 4*a*, 4*a*1 and 4*c*. The metal connection posts 4*a*1 and 4*a* are respectively connected with the metal connection posts 8*c* of the second backplate 8, while the metal connection post 4*c* is electrically connected with the metal connection post 8*d* of the second backplate 8.

The substrate 5 has a first metal layer 5*a* which is located on the inner (upper) surface thereof, a second metal layer 5*b* which is located on the outer (lower) surface thereof and a plurality of metal connection posts 5*c* establishing an electrical connection between the first metal layer 5*a* and the second metal layer 5*b*.

The driving circuit element 6 is mounted on the upper surface of the substrate 5 and establishes an electrical connection with the first metal layer 5*a* via the metal wires 7*a*, 7*b*, 7*c*, 7*d*, 7*e* and 7*f*. The connection parts of the first metal layer 5 for contacting the metal wires 7*a*, 7*b*, 7*c*, 7*d*, 7*e* and 7*f* with corresponding metal connection posts. The second metal layer 5*b* is graphically divided into a plurality of electrode pads 5*d*, 5*e*, 5*f*, 5*g* etc, wherein the electrode pads 5*d* and 5*g* are defined as grounding pads. The electrostatic loudspeaker has three connection paths. The first connection path consists of two connection branch paths. The metal wire 7*a* electrically connects with the first metal layer 5*a*, the metal connection posts 4*a*1, 3*a* and 2*a* to establish the first connection branch path. One part of the first metal layer 5*a* which has relationship with the metal wire 7*a* and electrically connects with the metal connection posts 4*c* and 8*d* establishes the second connection branch path. The metal wire 7*f* electrically connects with the first metal layer 5*a* and the metal connection post 4*a* to establish the second connection path. The metal wires 7*c* and 7*d* electrically connects with the first metal layer 5*a* and the metal connection posts 5*c* to establish a third connection path. When electrical signals are inputted from the electrode pads 5*e* and 5*f* and transmitted into the driving circuit element 6 via the third connection path. The driving circuit element 6 converts the electrical signals into driving signals. One road of the driving signals gets to the first metal film 1*b* of the backplate 1 via the first connection branch path. Another road of the driving signals gets to the second metal film 8*a* of the second backplate 8 via the second connection branch path. For the inverse voltage are applied to the two backplates 1 and 8, the threshold value of the sound power is increased and the structure is optimized. The other road of the driving signals gets to the metal film 3*b* of the diaphragm 3 via the second connection path. The metal shielding layer 1*c*, the metal shielding interlayer 1*d*, 2*b*, 3*c* and 4*b*, the second metal layer 5*b* (grounding pads 5*d* and 5*g*), some of the metal connection posts 5*c* and the metal wires 7*b*, 7*e* are electrically connected together and jointly forms into the shielding case which encloses substantial parts or elements of the electrostatic loudspeaker to prevent them from exterior interference. Although the shielding case improves the performance of the electrostatic loudspeaker of the third embodiment, the scope of the present invention is not limited to the one having it.

In addition, the electrostatic loudspeaker can be surface mounted because of special structure of the substrate 5. As an alternative, the metal layer 5*b* of the substrate 5 forms on the upper surface of the backplate or the first backplate 1 so that the backplate or the first backplate 1 can be surface mounted with zero height after increasing the number of the metal connection posts, and hereby, achieve the multi-surfaces mounted assembly function of electrostatic loudspeaker according to the present invention. For this kind of structure, the present invention is easy to be manufactured and assembled in a large quantity, and decrease the production cost.

While specific embodiments have been illustrated and described, numerous modifications come to mind without significantly departing from the spirit of the invention and the scope of protection is only limited by the scope of the accompanying claims.

We claim:

1. An electrostatic loudspeaker comprising:

a backplate having a metal film acting as one electrode of a capacitor and defining a plurality of sound apertures therein;

a diaphragm insulatively spaced a distance from the backplate to form the capacitor, the diaphragm comprising a metal film acting as the other electrode of the capacitor;

a back chamber having a substrate and an insulative spacer joining edge portions of the diaphragm and the substrate;

a driving circuit element converting electrical signals from exterior input pads into driving signals to drive the diaphragm to vibrate and sound, the driving circuit element being mounted on an inner surface of the substrate and being accommodated in the back chamber; and a first, second and third connection paths electrically connecting the driving circuit element with the two electrodes of the capacitor and the exterior input pads respectively.

2. The electrostatic loudspeaker as claimed in claim 1, further comprising an insulator connecting and supporting edges portions of the backplate and the diaphragm.

3. The electrostatic loudspeaker as claimed in claim 2, wherein the first and second connection paths comprise a plurality of metal connection posts which respectively extending through upper and lower surfaces of the insulator, diaphragm and the insulative spacer for electrically connecting with each other.

4. The electrostatic loudspeaker as claimed in claim 1, wherein the substrate has a first metal layer formed on the inner surface thereof and a second metal layer formed on an outer surface thereof and wherein the first metal layer is divided into several separate parts which are electrically insulative to each other for respectively establishing an electrical connection with the backplate, diaphragm and exterior input pads.

5. The electrostatic loudspeaker as claimed in claim 4, wherein the substrate further has a plurality of metal connection posts connecting the first metal layer and the second metal layer.

6. The electrostatic loudspeaker as claimed in claim 4, wherein the first, second and third connection paths comprise a plurality of metal wires, and wherein a part of the metal wires are provided to transmit the driving signals from the driving circuit element to the backplate and diaphragm and the other part of the metal wires are provided to input the electrical signals to the driving circuit element.

7. The electrostatic loudspeaker as claimed in claim 1, further comprising a shielding case enclosing the first, second and third connection paths therein.

8. The electrostatic loudspeaker as claimed in claim 7, wherein the shielding case comprises a metal shielding layer covering an outer surface of the backplate, a plurality of metal shielding interlayer respectively extending through upper and lower surfaces of the backplate, and wherein the metal shielding layer is divided into a plurality of grounding pads, the diaphragm and the insultive spacer and the grounding pads being formed on an outer surface of the substrates.

9. The electrostatic loudspeaker as claimed in claim 1, wherein the back chamber is acoustically airtight.

10. The electrostatic loudspeaker as claimed in claimed 2, wherein the exterior input pads are formed on an outer surface of the backplate.

11. An electrostatic loudspeaker comprising:

a first and second backplates each having a metal film;

a diaphragm being sandwiched between the first and second backplates and having a metal film which forms a first capacitor with the metal film of the first backplate and a second capacitor with the metal film of the second backplate, the metal films of the first and second backplates being applied inverse voltage when the electrostatic loudspeaker working;

a substrate located below the diaphragm;

a driving circuit element mounted on the substrate to convert electrical signals from exterior input pads into driving signal to drive the diaphragm to vibrate and sound;

a plurality of connection paths electrically connecting the driving circuit element with the metal films of the first backplate, the second backplate and diaphragm, and the exterior input pads respectively; and a shielding case enclosing the connection paths therein.

12. The electrostatic loudspeaker as claimed in claim 11, further comprising a back chamber surrounded by the substrate, the second backplate and an insulative space connecting edge portions of the substrate and the second backplate.

13. The electrostatic loudspeaker as claimed in claim 12, wherein the back chamber is acoustically airtight.

14. The electrostatic loudspeaker as claimed in claim 11, further comprising a first insulator connecting and supporting edges portions of the first backplate and the diaphragm, and a second insulator connecting and supporting edges portions of the second backplate and the diaphragm.

15. The electrostatic loudspeaker as claimed in claim 11, wherein the shielding case comprises a metal shielding layer covering an outer surface of the first backplate, a plurality of metal shielding interlayers respectively extending through upper and lower surfaces of the first backplate, and wherein the metal shielding layer is divided into a plurality of grounding pads, the diaphragm and the insultive spacer and the grounding pads being formed on an outer surface of the substrates.

16. An electrostatic loudspeaker comprising:

a first and second backplates each having a metal film;

a diaphragm being sandwiched between the first and second backplates and having a metal film which forms a first capacitor with the metal film of the first backplate and forms a second capacitor with the metal film of the second backplate;

a back chamber having a substrate and an insulative spacer joining edge portions of the second backplate and the substrate, the substrate having a first metal layer which is formed on an inner surface of the substrate and is divided into several separate parts electrically insulated from each other;

a driving circuit element to convert electrical signals into driving signals driving the diaphragm to vibrate and sound, the driving circuit element being mounted on the inner surface of the substrate and being accommodated in the back chamber; and a plurality of metal connection posts extending through the diaphragm, the second backplate, the insulative space and the substrate; the metal connection posts of the diaphragm, the second backplate, and the insulative space electrically connecting with some of the separate parts of the first metal layer to establish one connection path; the connection post of the insulative space electrically connecting with another some of the separate parts of the first metal layer to establish another connection path; the connecting posts of the substrate electrically connecting with the other some of the separate parts of the first metal layer to establish other connection path; the one connection path and the another connection path providing inverse voltage to the metal films of the first and second backplates from the driving circuit element.

17. The electrostatic loudspeaker as claimed in claim 16, further comprising a first insulator connecting and supporting edges portions of the first backplate and the diaphragm, and a second insulator connecting and supporting edges portions of the second backplate and the diaphragm.

18. The electrostatic loudspeaker as claimed in claim 16, further comprising a shielding case enclosing the connection paths therein.

19. The electrostatic loudspeaker as claimed in claim 16, wherein the back chamber is acoustically airtight.

20. The electrostatic loudspeaker as claimed in claim 16, wherein the exterior input pads are formed on an outer surface of the first backplate or an outer surface of the substrate.

* * * * *